US005141449A

United States Patent [19]

Tieszen

[11] Patent Number: 5,141,449

[45] Date of Patent: Aug. 25, 1992

[54] SNAP-ON LIGHT SOCKET

[75] Inventor: Dwayne A. Tieszen, Ponder, Tex.

[73] Assignee: Vista Manufacturing, Inc., Elkhart, Ind.

[21] Appl. No.: 756,048

[22] Filed: Sep. 6, 1991

[51] Int. Cl.[5] ..... H01R 4/24

[52] U.S. Cl. ..... 439/419

[58] Field of Search ..... 439/417-419, 439/425, 426

[56] References Cited

U.S. PATENT DOCUMENTS

| | | | |
|---|---|---|---|
| 3,214,724 | 10/1965 | McIntosh | 439/419 |
| 3,660,801 | 5/1972 | Paulfus | 439/419 |
| 4,264,117 | 4/1981 | Pritulsky | 439/419 |

*Primary Examiner*—Joseph H. McGlynn

*Attorney, Agent, or Firm*—James D. Hall

[57] ABSTRACT

A snap-on light socket for a flexible light strip assembly includes a plurality of sockets which are removably and randomly fixed to a standard insulated wire (conductor). The socket is, in affect, comprised of a primary chamber into which is inserted a pair of cooperating contacts which serve to grip a conventional wedge base lamp and which have sharply pointed portions extending therefrom which pierce the insulation of the wire to effect the electrical connection. A lower tunnel-like channel is formed to accept and to grip the insulated wire and includes slotted means permitting the said sharply pointed portions of the contacts to extend partially into said channels to be in position to pierce the insulation when the socket is affixed to the insulated wire.

7 Claims, 2 Drawing Sheets

SNAP-ON LIGHT SOCKET

This invention is related to light assemblies and more specifically to an improved socket for use with flexible light strip assemblies which may be randomly attached to an electric current carrying cord.

BACKGROUND AND SUMMARAY OF THE INVENTION

Flexible light strip devices are well known and have achieved a great degree of popularity, not only in the form of holiday ornamentation, but also for decorative lighting throughout the year. Such devices utilize what is generally referred to as wedge base lamps or bulbs and special insulated wire.

Wedge base lamps are so common as not to warrant detailed description here, as they are not the invention but are merely utilized in the present invention. Suffice it to say that this typse of bulb generally consists of a filament-containing glass envelope with a wedge shaped base designed to be mated with an appropriately formed socket. The filament conductors extend through the wedge base and are back-bent over the external surface of the envelope base. The socket contains contact members which conduct current to the filament conductors.

We are here concerned with the socket structure, in combination with standard 18 gauge wire, which may be of any desired length.

The present invention is directed, not to randomly strung, mass-produced, strings of lights used for decorative purposes, but to those conditions and locations where specific non-uniform areas or articles are to be lighted.

Similarly to the prior art, the present invention utilizes flexible insulated wire. However, unlike the prior art devices, the current invention needs no special wire, but uses standard household wiring.

It is frequently desired to light, for example, only certain portions or areas of glass cabinets or shelving in order to highlight certain objects or curios. Using conventional light strip devices, it is not only difficult to place a light at a desired location, but also there will generally be an unwanted light dangling in space or lying on a shelf lighting an empty area.

For this reason, there have in recent times been developed a number of light strips which permit random insertion of plug units. Most, however, necessitate the utilization of special tools for piercing the wire insulation, special wire or conductive strips, special backing plates, locking plates or other relatively complex structures. Other such prior art systems are very bulky, need specially made bulbs or the bulbs themselves are not replaceable without replacing the entire socket.

The foregoing disadvantages are overcome by the present invention through the provision of a compact socket for a common wedge based lamp which requires no assembly, no special or additional backing or locking plates, no special tools, which is formed in a single piece and which has a bulb receiving cavity allowing for easy replacement of bulbs.

Further, this unique socket eliminates part count, bulk and space requirements essential in prior art designs. There in no fixed or set number of sockets for a given wire or fixture.

The sockets of the current invention may be randomly placed on standard insulated wire singly or in groups immediately adjacent one to another or to several, and may be themselves removed and placed on another segment of wire or placed on another wire without damage to or destruction of the sockets. All done without the use of special tools, parts, space requirements or special training.

Each socket is molded into a simple unitary housing having two distinct cavities therein, into one of which are inserted two mirror-image contacts. A sharp tip portion of each contact extends into the second housing cavity. Those portions of the contacts which are in the first cavity cooperate to form a bulb receiving and grasping section. The second of said cavities is shaped to tightly receive a standard segment of wire in such a position relative to the two contacts that, when pressed into position, the tip portions of the contacts pierce the insulation and make electrical contact with the wires therein.

The current invention offers a safety feature not previously found and which permits the socket to be handled and applied without fear of cutting. All portions of the contact, including the sharp, wire-piercing tips, are contained inside the socket. Therefore, the user cannot cut or injure him or herself.

Accordingly, it is an object of this invention to provide an improved snap-on light socket which may be randomly connected to a standard gauge insulated electrical wire.

It is a further object of this invention to provide a snap-on light socket which utilizes commercially available wedge base lamps.

It is another object of this invention to provide a snap-on light socket wherein the contacts are compeletely self-contained, thereby precluding damage or cuts to the user.

It is another object of this invention to provide a snap-on light socket which is economically manufactured and readily adapted to a variety of uses.

Further and other objects will become apparent upon consideration of the detailed description of the preferred embodiment of the present invention.

BRIEF DESCRIPTION OF THE DRAWINGS

A preferred embodiment of the invention has been chosen for purposes of illustration wherein.

DETAILED DESCRIPTION OF THE PREFERRED EMBODIMENTS

Certain terminology will be used herein for convenience only and is not to be taken as a limitation on the invention. For example, there are no "upper" or "lower" cavities in the invention, nor is there a "front" or "rear", because the socket may be applied to the wire with the lamp facing in either direction. Indeed, there is no "direction". Sockets may be applied adjacent one to another with the lamps facing each other or with the lamps facing away from each other. Lamps may be applied to either "side" of the wire conductor.

Thus, it will be understood that certain components and parts are referenced with regard to their placement on the drawings, and this is done solely for the sake of understanding and illustration, not in a limiting sense.

Figure 1:
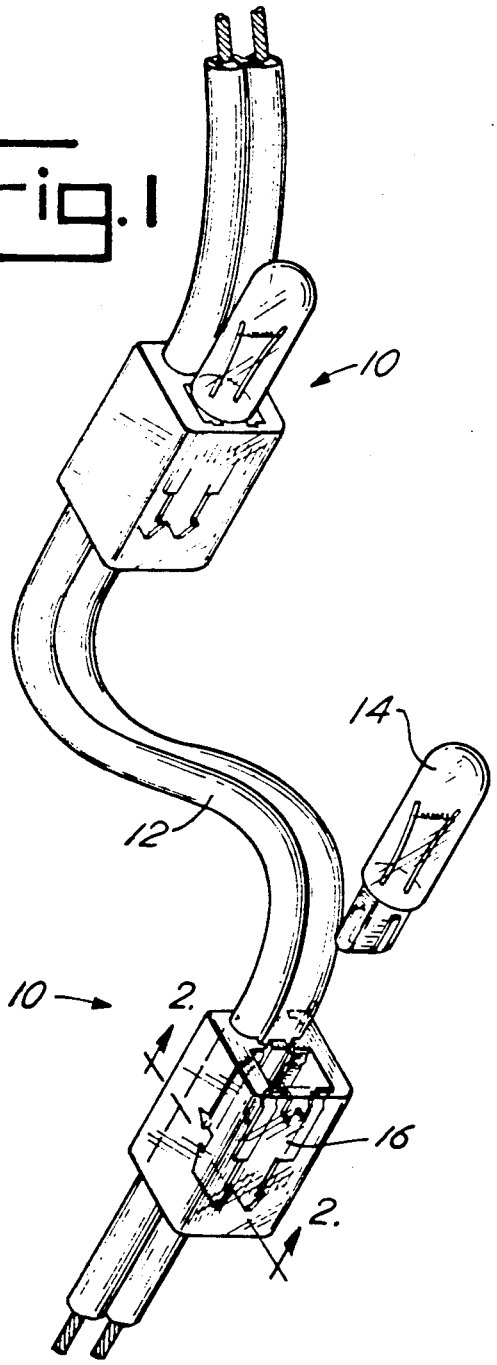
FIG. 1 is an isometric view of two sockets of this invention mounted at random on a length of insulated wire.

Referring now to the drawings, wherein like reference characters designate identical or corresponding components and units throughout the serveral views, there is shown a snap-on light socket generally designated by reference numerals 10. More particularly, in FIG. 1 there is shown a flexible light strip assembly comprising a length of insulated wire or conductor 12 to which have been attached two sockets 10.

Each socket 10 includes means to accommodate a conventional wedge base lamp 14, in the size range of T-1 ¼ to T-1 ¾, of low voltage, a pair of contact means 16 electrically connecting lamp 14 to insulated wire 12, said socket having a tunnel-like portion thereof so shaped as to grasp insulated wire 12 when applied thereto.

Each socket 10 is preferably of molded plastic or like non-conductive material, molded in a generally rectangular configuration with its longitudinal axis being the greater of the two. In cross-section, socket 10 is of a generally square configuration. Each socket 10 has what we will refer to for purposes of illustration as a front end 22 and a rear end 24.

Figure 2:
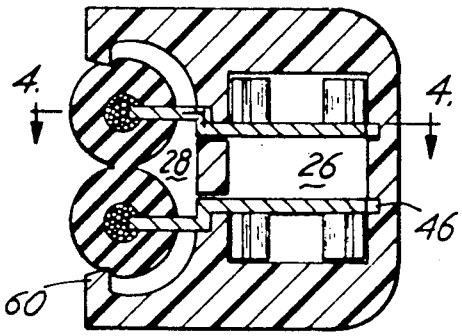
FIG. 2 is a cross-section of one of the sockets of FIG. 1, taken along lines 2—2 of FIG. 1, illustrating the electrical connection between the contacts and the insulated wire.
Figure 3:
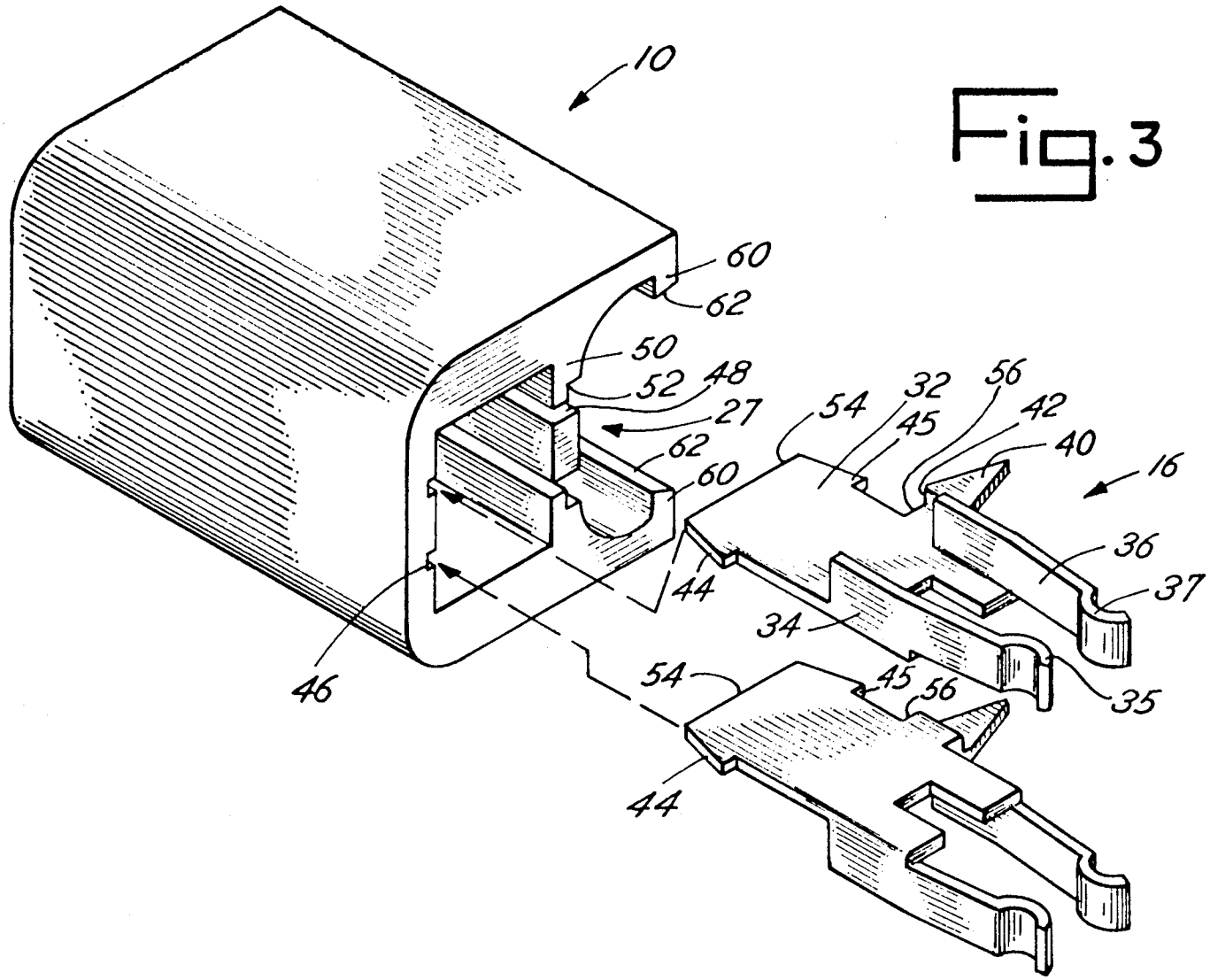
FIG. 3 is an exploded isometric view of the socket of this invention, indicating the shape of the contacts and the manner in which they are inserted into said sockets.

As can best be seen in FIGS. 2 and 3, each socket 10 is molded with what we will refer to for purposes of illustration as an upper cavity or chamber 26 and a lower cavity or chamber 28 separated by a thin wall 27. Both chambers extend from front end 22 to rear end 24 of socket 10. However, in order to facilitate application of socket 10 to insulated wire 12, the rear end of chamber 28 is open. That is to say, lower chamber 28 is a channel through socket 10. In cross section, lower chamber 28 is of a generally rotundate shape. Rear end 24 of socket 10 at upper chamber 26 is closed. Upper chamber 26 and lower chamber 28 are separated by thin wall 27, the details of which will be subsequently described.

Contacts 16 are stamped and bent to their desired shape and are of a conventional tin-plated copper electrical conducting material. As previously explained, because of the versatility of sockets 10, there is no "up", "upward," "down" or "downward" attitude. However, for purpose of illustration only, we will herein consider lower chamber 28 to be on the "downside" and insulated wire 12 to be in a "downward" direction with respect to socket 10.

As mentioned previously, contact means 16 comprises a pair of mirror-image conductors which connect the leads of wedge base lamps 14 to insulated wire 12. For purposes of simplicity in the explanation, only one contact will be described, the relationship of the two being clearly understood.

Figure 4:
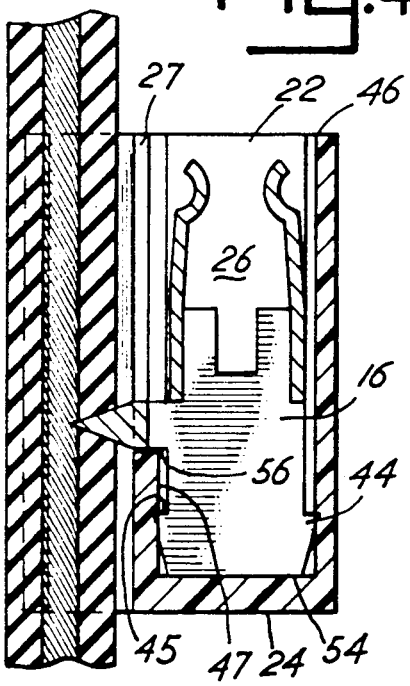
FIG. 4 is a longitudinal cross-section of the socket, mounted on insulated wire, taken along line 4—4 of FIG. 2.

Each contact 16, besst seen in FIGS. 3 and 4, is made of flexible spring-like composition and comprises a generally rectangular base portion 32, of a size approximating the vertical "height" of chamber 26. Bent from opposite surfaces and extending from base 32 are an upper arm 34 and lower arm 36, bent toward each other to receive and releasably retain wedge base lamp 14. The ends 35 and 37 of arms 34, 36, respectively, have semi-circular tips to better grasp and retain lamp 14.

Extending "downward" from base 32 is a sharpely pointed tip 40. Tip 40 is offset at 42, best illustrated in FIGS. 2 and 3, for spacing as well as for support. Tip 40 extends approximately half way through lower chamber 28. At the opposite end of contact 16 are formed two barbs 44 which serve, in cooperation with other features of socket 10 which will hereinafter be described, to hold contacts 16 in a fixed and fast position within socket 10.

At the "roof" of upper chamber 26 are two channels 46, of such a width as to be approximately the thickness of contacts 16, but of a depth slightly less than the extent of barb 44. Well 27 is slotted for about two-thirds the distance from the front end toward the rear end of socket 10. Each slot 48 is of such a width as to accommodate the thickness of contact 16. The outer edge 50 of slot 48 includes a notch 52 which extends its entire length and which is formed to correspond with offset 42.

Slot 48 is designed and formed such that it terminates at a point generally corresponding to the distance from rear face 54 of contact 16 to rear edge 56 of tip 40. From that point to approximately the rear end of socket 10, there is formed channel 47, opposite from and corresponding to channel 46. Channel 47 accommodates barb 45 of contact 16.

The distance from the bed of channels 46 to the beds of channels 47 is molded to be slightly less than the distance from the tips of barbs 44 to the tips of barbs 45 of contact 16. Since contact 16 is of a spring-like flexible metal, this lends itself to a very tight fit when contact 16 is forcibly and slidably inserted into chamber 26 of socket 10.

It has previously been explained that lower chamber 28 is of a generally rotundate shape. That is to say, chamber 28 is formed as a tunnel through socket 10, with an open "bottom". That portion of wall 27 between slots 48 is flat; from the outer edge of notch 52, the surface of chamber 28 is arcuate toward the "bottom" of chamber 28. At the bottom terminus of both edges there is an interiorly facing tip 60, the upper surface of which is flat and in the same horizontal plane as the horizontal plane of socket 10. Tips 60 extend along the entire length of chamber 28, on either side, facing one another. Interior facing surfaces 62 of tips 60 are tapered so to give tip an inwardly facing point.

Pointed tips 60, protruding into chamber 28, cooperate to form a gripping surface when socket 10 is pressed against insulated wire 12. With contacts 16 assembled into socket 10, tips 40 protrude approximately half way down into chamber 28. When socket 10 is pressed onto insulated wire 12, insulated wire occupies the entire chamber, tips 40 penetrate through the insulation and make contact with the conductive wire, and tips 60 serve to assist in holding socket 10 and wire 12 in a fixed relationship.

By virtue of the foregoing, the present invention provides an improved, unique snap-on light socket for wedge base lamps which permits greater flexibility than heretofore existed, by virtue of the ability of the sockets to be randomly and fixedly positioned on a conventional insulated wire, without the use of any special tools, parts, backing plates, locking plates or adhesives.

In operation a socket is assembled by inserting two contacts into a chamber within the socket. One end of the chamber is open and the other closed; the chamber is slotted and channelled to receive each contact. The receiving portions are so shaped that the contacts cannot be wrongly inserted.

When inserted to their full extent, the contacts are fully within the socket, with arrow-like pointed portions protruding into a second chamber, which is shaped much like an open-bottomed tunnel.

The socket is pressed against the insulated wire with the open bottom surrounding the wires or, the wire is pressed into the open bottom of the socket. When so impressed, the pointed portions of the contacts penetrate the insulation and contact the wire. Gripping means at the bottom edge of the chamber serve to prevent the wire and the socket from separating.

A conventional wedge base lamp is inserted into the open end of the socket and electrical contact is effected through flexible gripping arms of the contact. Of course, it will be evident that t a lamp may be inserted into the socket prior to the placement of the socket onto the wire. When lamps burn out, they may readily be replaced.

If, for example, it is desired to light objects in a curio cabinet or on a shelf, a length of flexible insulated wire may be appropriately snaked around and near such objects, which may be back-lighted or front-lighted. A socket may be fixed at each desired station, on either side of the wire. Two sockets may be attached to the wire adjacent one another, back to back or light to light, to increase the intensity at that station. Indeed, a plurality of sockets and lights may be attached to the wire in a continous line of any given length.

Once the concept and principle are understood, the variety of uses and placement of sockets is limitless. The present invention permits a user to selectively illuminate a wide variety of object in a wide variety of ways.

It will be appreciated that this invention is not limited to the precise form disclosed or by the terms of the above description, but may be modified without departing from the scope and the appended claims.

What is Claimed is

1. A lamp assembly, comprising:

a lamp housing molded from an electrically non-conductive plastic, an electrically conductive insulated wire, an elongatued U-shaped portion in said lamp housing receiving said electrically conductive insulated wire, a chamber above and adjacent said U-shaped portion, said chamber having an open and a closed end and being slotted and channelled to recieve an electrical contact member, said electrical contact member fitted into said chamber an having means at one end thereof to grip said lamp housing chamber when inserted therein, means at the opposite end thereof for receiving and making electrical contact with a lamp and means intermediate thereof which extends into said U-shaped means, said open end of said chamber adapted to accommodate said lamp-receiving means and to receive a lamp, said intermediate means extending into said U-shaped means being of sufficient length as to pierce the insulation of said electrically conductive wire when said wire is inserted into said U-shaped means, to establish electrical contact between said wire and said lamp.

2. The lamp housing of claim 1 wherein said lamp housing is generally rectangular in a longitudinal axis parallel to the axis of said electrically conductive insulated wire and generally square in cross section.

3. The lamp housing of claim 1 wherein between said elongated U-shaped portion and said chamber is a thin wall which is slotted and channelled to receive said electrical contact member and wherein the upper wall of said chamber is so channelled in corresponding relationship thereto.

4. The electrical contact member of claim 1 wherein said means for gripping said lamp housing consists of forwardly facing outwardly extending barbs which extend into said channelled portions of said chamber and said U-shaped portion of said lamp housing.

5. The electrical contact member of claim 1 wherein said means intermediate said electrical contact member is sharply pointed generally in the shape of an elongated triangular arrow head.

6. The lamp housing of claim 1 wherein said elongated U-shaped portion further includes at the open portion thereof a pair of inwardly facing tips extending the length of said U-shaped portion and being spaced apart a distance less than the width of said electrically conductive insulated wire, said tips serving to retain said wire in said U-sahped portion when said wire and said U-shaped portion are pressed together.

7. The lamp assembly of claim 1 wherein said lamp housing and said electrical contact member are adapted to receive a wedge base bulb.

* * * * *